United States Patent [19]

Parr

[11] 4,253,101

[45] Feb. 24, 1981

[54] POWER TRANSFER RIPPLE REDUCTION METHOD AND MEANS FOR ROTARY ANNULAR LOOP RF COUPLER

[75] Inventor: John C. Parr, Woodland Hills, Calif.

[73] Assignee: International Telephone and Telegraph Corporation, New York, N.Y.

[21] Appl. No.: 107,397

[22] Filed: Dec. 26, 1979

[51] Int. Cl.[3] ..... H01Q 3/00

[52] U.S. Cl. ..... 343/763; 333/261

[58] Field of Search ..... 343/761–763, 343/839, 854, 876, 106 R, 100 R; 333/128, 245, 261

[56] References Cited

U.S. PATENT DOCUMENTS 2,426,226 8/1947 Labin et al. ..... 333/261

3,066,291 11/1962 Alford ..... 333/261

3,123,782 3/1964 Parisi ..... 343/763

*Primary Examiner*—David K. Moore

*Attorney, Agent, or Firm*—William T. O'Neil

[57] ABSTRACT

A rotary annular, around-the-mast, radio frequency coupler having two concentric sets of generally axial loops, one fixed (stator set) and the other rotatable (rotor set) for electromagnetically coupling between a fixed and rotatable structure, such as a rotating antenna sub-system.

Two methods and corresponding structure are provided for reducing the power transfer ripple occurring during rotation. These are prime related different loop totals between rotor and stator and angular canting of one loop set with respect to the other.

14 Claims, 5 Drawing Figures

POWER TRANSFER RIPPLE REDUCTION METHOD AND MEANS FOR ROTARY ANNULAR LOOP RF COUPLER

BACKGROUND OF THE INVENTION

1. Field of the Invention

The invention relates to microwave systems generally, and more particularly to an RF feed operative between fixed transmit/receive apparatus and a rotating antenna array, or the like.

2. Description of the Prior Art

The general problem of providing a rotating RF transmission line joint between a rotating antenna system and fixed transmitter, receiver and signal processing apparatus is nearly as old as the radar itself. Various forms of such rotating joints or couplings have been developed and are known in this art. A few of these include the rotating circular waveguide joint, the rotating coaxial coupling, and various hybrid arrangements in which there are one or more transitions from one transmission line medium to another.

The unique problem in shipboard radar arises when, for reasons intended to minimizing antenna blockage from ship superstructure, a rotating antenna is essentially mounted at the top of a mast. In such cases, it is particularly useful to provide some form of around-the-mast coupler, a part of which rotates with the antenna array and a part of which remains fixed for connection to the fixed apparatus, typically a transmitter, receiver and other signal processing equipment. One form of such a coupler is described in U.S. Patent Application Ser. No. 040,325 filed May 18, 1979, and is entitled "Around-The-Mast Rotary Coupler." That patent application is assigned to the assignee of the present application. In it, two matching, annular, cellular rings rotate with respect to each other. The cells of each of these rings are actually waveguide sections and energy transfer is effected during rotation.

One inherent problem associated with the aforementioned rotary coupler is this same fact, namely that the individual cells of the annular rings are in effect short sections of waveguides, and are therefore subject to the low frequency cut-off characteristic of waveguide. This means that, for relatively low microwave frequencies, the cross-sectional dimensions of these waveguide cells becomes relatively large. The result in size, weight and cost factors can be disadvantageous.

Of further interest in the prior art is U.S. Patent Application Ser. No. 77,850, filed Sept. 21, 1979 and entitled "Loop Coupler Commutating Feed." In that disclosure, the concept of fixed and rotating loops coupling to each other is presented and could be adapted to the rotary coupler use, however its diameter is relatively large since the loops are radially oriented. More importantly, however, it is not adapted to the around-the-mast configuration, and is essentially useful as background hereto because of the basic, coupled, elongated loop concept which it discloses in common with the invention herein.

Also of interest as background is U.S. Patent Application Ser. No. 19,481, filed Mar. 12, 1979 and entitled "Large Scale Low-Loss Combiner and Divider." That device, which does not involve moving parts is not a coupler per se, and is not directly applicable to the around-the-mast rotary coupler application, but like the aforementioned U.S. Patent Application Ser. No. 77,850 employs magnetically coupled elongated loops in independent input/output groups.

An annular RF coupler of the form to which the present invention is particularly applicable is described in a copending U.S. Patent Application entitled "Around-The-Mast Rotary Annular Antenna Feed Coupler," George A. Hockham and Ronald I. Wolfson inventors and identified by the assignee as Hockham-Wolfson 15-5.

All four of the aforementioned background patent applications are assigned to the same assignee as is the present invention.

In consideration of the background art and the particular problem to be solved, the manner in which the invention advances the state of this art will be understood as this description proceeds.

SUMMARY

It may be said to have been the general objective of the present invention to provide a compact, around-the-mast, rotary coupler for transferring radio frequency signals between the rotating antenna and fixed associated circuitry through magnetic loop coupling according to a method and with means for minimizing power transfer ripple. The apparatus of the invention is constructed around a central axial opening of circular cross-section for around-the-mast installation. Within a conductive housing, an annular chamber is provided into which a first group of fixed, elongated, conductive loops are installed, these loops extending generally axially about the full 360° cross-section. A rotatable assembly provides a second group of similar loops, these being mounted on a rotatable assembly so that they revolve as a group about a common center with respect to the fixed loops in radial juxtaposition therewith. The fixed loops in the representative embodiment to be described hereinafter, are on the inside, i.e. laterally tangent to a smaller circle than are the rotating loops which are laterally distributed about a somewhat larger circle.

The method and means for minimizing the so-called power transfer ripple involve a unique circumferential distribution of rotating (rotor) loops extant in a plurality greater than the plurality of fixed loops, the numbers of loops in each set being prime to each other. In lieu thereof, or in addition, the long dimensions of the loops of one set (preferably the rotor set) are angularly canted with respect to the long dimension of the loops of the other (stator) set. Those long dimensions are generally axial with respect to the overall assembly.

An "equal-path-length" feed arrangement is illustrated and described in connection with the implementation of a system employing the loop coupler of the combination.

The device of the invention is not subject to low frequency cut-off as is the case in waveguide devices, and accordingly can be constructed more compactly and with correspondingly higher bandwidth capability. Typically, a bandwidth of at least 50 percent is readily achievable. The power transfer between the fixed and rotating loop sets is made relatively constant with rotation, the periodic power ripple caused by reflected power due to the mismatch that occurs as the rotor loops pass over the gaps between adjacent fixed loops being minimized by the method and means of the invention in that the rotor loops are distributed and/or spaced so that stator loop gaps do not match rotor loop gaps completely at any instant. If one loop set comprises relatively wide loops with minimum gaps between them circumferentially, the other set may be relatively narrow in their transverse or circumferential dimension and still provide relatively constant power transfer.

The details of an embodiment based on the principles of the invention will be described hereinafter.

DETAILED DESCRIPTION

Figure 1:
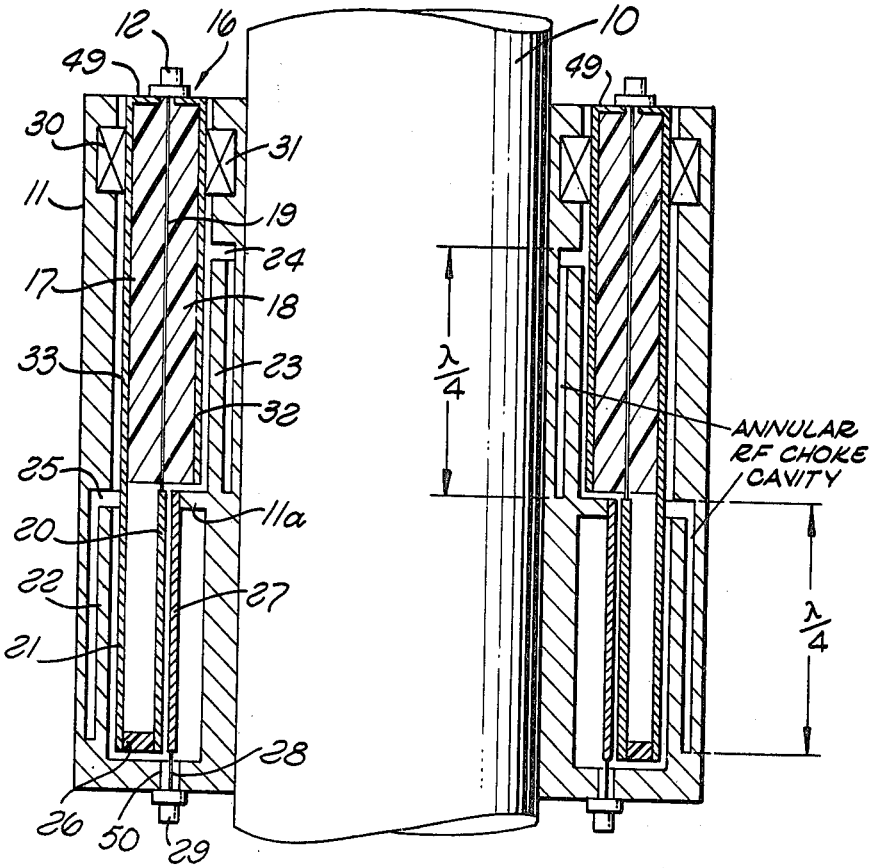
FIG. 1 is an axially sectioned view of a coupler according to the invention as it would be installed about a mast or column.

Referring now to FIG. 1, the apparatus of the invention will be seen in section with its axial cylindrical central opening emplaced over a mast 10. The housing 11 will be understood to be generally annular in a plane normal to the axial center line of the mast 10 and therefore to the axial center line of the central axial cavity generally congruent with the mast 10 in the illustration of FIG. 1.

Figure 2:
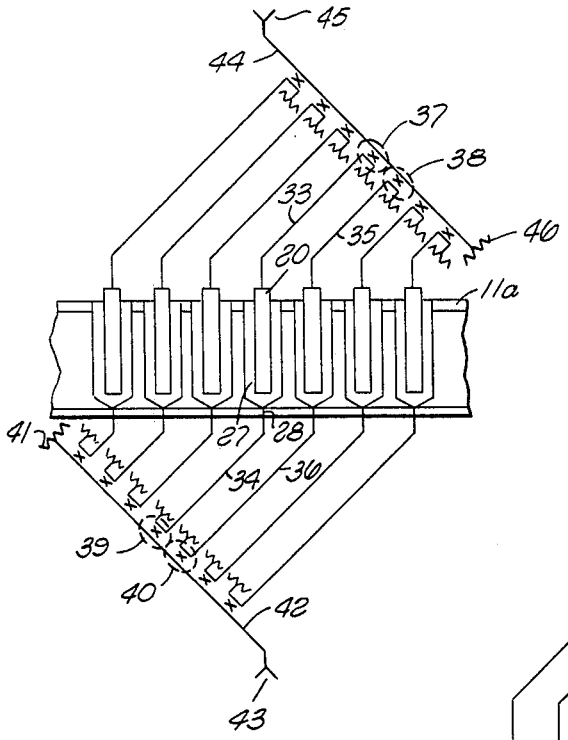
FIG. 2 is a flat development of a portion of the cylindrically disposed rotor and stator loop sets corresponding to a radial view of FIGS. 1 and 1A with the housing removed.

The cross-section of the housing 11 on either side of the mast 10 will be seen to be generally U-shaped in an axial plane, i.e. without the rotating assembly generally identified at 16. Within this housing the fixed loops or stator loops are distributed circumferentially, typically at 27 in FIG. 1. The radially outward projection 11A forms a conductive pedestal for loop leg 27, the loop being also connected at the lower end to a coaxial center conductor 28 passing through a bore 50 in the bottom of housing 11, where an external port in the form of a coaxial connector 29 provides a connection thereto. The outer conductor of the coaxial connector 29 is electrically and mechanically connected to the housing 11 at that point and the radially inward wall of housing 11 forms a fixed loop return path. The coaxial connector 29 representing one of the fixed loop ports is one of the set of first ports referred to hereinafter. In FIG. 2, a development of the cylindrically distributed first or fixed loops as well as the rotating loops of the second loop set, typically 20 in FIGS. 1 and 2, is shown. The development showing of FIG. 2 may be considered to be a radially inward view taken in the absence of the extended conductive cylindrical shell 21 and the housing 11 radially outward wall. Further discussion of FIG. 2 will follow during and after the description of FIG. 1, as appropriate.

Considering now the rotating assembly generally at 16, this comprises what may be referred to as first and second axial sections, the first axial section, or lower part as depicted in FIG. 1, comprises the loop leg 20 with its conductive pedestal 26 connected to the conductive cylindrical shell extention 21. The second, or upper part, comprises the stripline section between conductive cylindrical shells 33 (from which 21 is extended) and 32 on the radially inward side. Insulation portions 17 and 18 comprise the solid dielectric of the stripline arrangement and 19 is the typical center conductor strip which will be seen to be connected to loop leg 20. The coaxial connector 12 is one of the plurality of second or rotating ports shown as 12, 13, 14 and 15 etc., on FIG. 1A. A metal or metalized top strip 49 covers the upper end of the dielectric 17 and 18 with a clearnace opening for the stripline conductor 19 which connected to the center conductor of the coaxial fitting 12. The outer conductor of coaxial connector 12 is returned to the two, conductive, cylindrical shells 32 and 33 which comprise the ground planes for the stripline assembly.

Of course, it will be realized that the rotor assembly includes plural circumferentially spaced conductors 19 within the stripline assembly, one for each of the circumferentially distributed, rotating loops 20 depicted in the development of FIG. 2.

Bearing 30 and 31 provide mechanical support and alignment with rotational freedom for the entire rotating assembly 16. It will be realized, however, that since axial and radial alignment and stability of the loop legs 20 and 27 with respect to each other is important in the obtaining of stable and predictable operation of the device. Accordingly, those of skill in this art will realize that additional bearing may be necessary. For example, an additional, radially outward bearing similar to 11 might be provided through the same wall of the housing farther down towards the choke aperture 25. Similarly on the radially inward side, the annular tongue 23 can be of sufficient thickness to provide for a bearing therein. Other expedient's of course are available, such as the provision of a much thicker stripline top plate 49 which might extend radially in both directions over the top ends of housing 11 to provide an additional function of axial constraint as well as electrical continuity between the outer conductor of coaxial connector 12 and the conductive cylindrical walls 32 and 33. Since mechanical support and variation thereof are well within the ordinary skill of this art, it is not thought to be necessary to discuss bearing support of the rotating assembly 16 any further.

In order to "close" the annular chamber housing the loops in a radio frequency sense, quarter-wave chokes are built-in to the housing as indicated, these have the effect of producing radio frequency short circuit points at 24 and 25. The choke cavities and tongues 22 and 23 defining these cavities are of course annular in shape extending the full 360° in the plane normal to the center line of mast 10 in FIG. 1. The operation of quarter-wave choke devices is well understood in art of microwave devices.

Figure 1A:
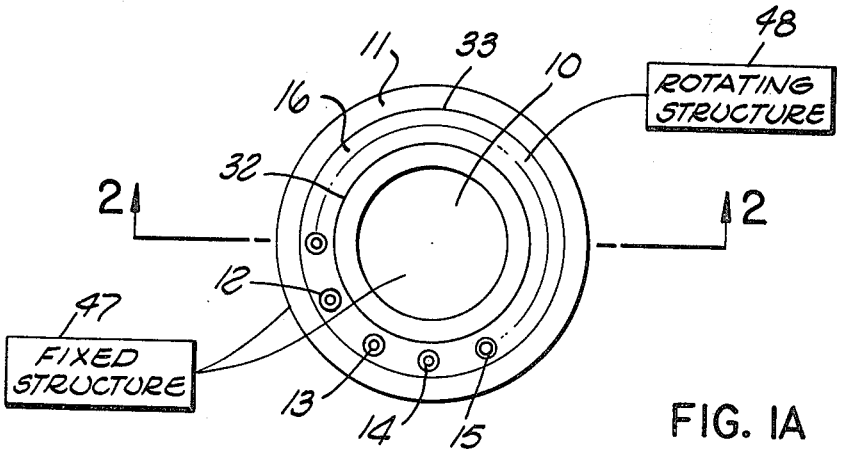
FIG. 1A is a top view of FIG. 1 in non-sectioned form but showing the sectioning plane applicable to FIG. 1.

In FIG. 1A the conductive cylindrical shells which form the ground planes for the upper or stripline assembly portion of the rotating assembly 16 are depicted. The blocks 47 and 48 are merely intended to indicate attachment to fixed and rotating structure respectively. That is, 47 represents the fixed structure of the ship or other platform to which the mast 10 is affixed. Block 48 represents the rotating structure including the antenna array which would be mounted on the mast 10 above the rotary coupler of the invention as depicted in FIG. 1, the rotating structure of 48 also including whatever drive and support structure would be normally included.

In FIG. 2 an interconnector arrangement for equal phase or equal path length summation of all the individual loop energy transfers is illustrated. A plurality of first fixed couplers, for example four-port, coaxial type couplers include 39 and 40 in a first group and 37 and 38 in a second group, the latter mechanically rotating with the rotor loops such as 20. Couplers 39 and 40 effectively couple in series into a first main line 42 which has a termination 41 and a stationary main line port 43, and individually connect, for example, by leads 34 and 36 (coaxial cable normally), to fixed loop legs 27 and an adjacent fixed loop in the manner already described connection with FIG. 1. Similarly the rotating ports connected to rotating loops such as 20 and adjacent one thereto are connected by leads 33 and 35 (also coaxial cable typically) to four port coaxial couplers 37 and 38 respectively. Thus the second main line 44, which physically rotates with the entire rotating superstructure in cooperation with the coaxial couplers 37 and 38 etc., provides the combination or division of energy so that 45 becomes a rotating port connectable to the antenna which is a part of the rotating superstructure. The second main line 44 also has a termination or load 46.

It will be noted that in the showing of FIG. 2, the rotating loops comprise narrower loop legs (such as 20) as compared to the typical fixed loop leg 27, this reducing rotational inertia. Since the configuration of the inter-connecting coaxial cable including 33, 35, 34 and 36 is intended to avoid phase disparity among the individual paths between 43 and 45, it follows that some signal energy phase disparity can exist between adjacent fixed and adjacent rotating loops, however this is not a significant consideration and accordingly the fixed loops may be designed with greater relative width and lesser circumferential spacing than implied on FIG. 2, that tending to reduce the aforementioned power transfer flutter.

In FIG. 1, it will be noted that the return paths for the loop legs, such as 20 and 27 are through the conductive cylindrical shell 21 and the radially inner portion of the housing 11. Thus while the loop legs such as 20 and 27 are discrete, the return paths are mingled in the conductive shell 21 and housing 11 respectively.

Basically, the loop legs 20 and 27 are electrically one-quarter wavelength, axially measured, however the dimensioning is not critical and small variations within ordinary mechanical tolerances are not of great significance.

In lieu of the stripline arrangement of the upper (second) axial section of the rotating assembly 16, a coaxial line between 12 and the rotating loop leg 20 might be employed as a variation. In that case, the dielectric 17 and 18 of the stripline configuration might be replaced by solid metal, with axial bores, the internal walls of which would provide the outer conductors for the coaxial transmission lines thereby formed with 19 etc., as its center conductor. The illustrated stripline structure is preferred from the point of view of ease of construction and overall lightness, since a low-density, dielectric medium can be employed at 17 and 18.

From an understanding of the invention it will be realized that the fixed loops can be placed adjacent the radially outward wall of the housing 11 rather than the radially inward wall as illustrated. In that alternative situation, the rotating loops are similarly reversed, their loop return paths being provided by a cylindrical conductive shell extended from 32 rather than 33.

Either the stripline or coaxial line medium between coaxial connector 12 and the loop leg 20 can be easily designed for an impedance match to the impedance presented by the loop. The factors affecting loop impedance include loop width, ground plane spacing and coupling to a loop of the other set (fixed or rotating). The practitioner of skill in this art can select the parameters of a particular design to provide proper impedance matching, which should be optimum when a rotor loop is centered over one of the stator loops. The technical literature including a paper entitled "Characteristic Impedance of Broad Side Coupled Strip Transmission Lines" by S. Cohn (IEEE Transaction-MIT., Vol 8, pp 633–637), summarizes the analytical approach through which specific loop parameters may be determined. In one embodiment of the invention, the convenient loop characteristic impedance of 50 ohms was selected, this being readily consistent with the impedance out through the coaxial connectors, typically 12 and 29.

Figure 3:
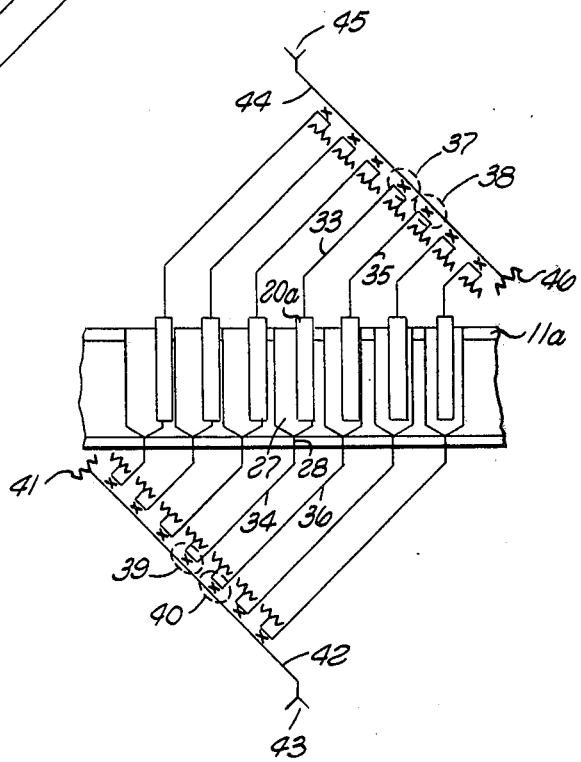
FIG. 3 is a flat development taken as in FIG. 2, except with the "prime related" loop configuration according to the invention.

Referring now to FIG. 3, it will be noted that the individual loops, typically 20*a*, of the rotor loop set, are differently (more closely) spaced, center-to-center than are the stator loops 27, etc. If the larger number of loops of the rotor is a prime number with respect to the number of loops in the stator assembly, then at no time will more than one rotor loop be place directly over the gap between adjacent stator loops. Accordingly, the signals from summed individual loop couplings are but negligibly affected by the power transfer ripple observable in the loop configuration of FIG. 2. Therefore the RF power transfer between terminals 43 and 45 has a smooth shape as a function of rotor angle.

Figure 4:
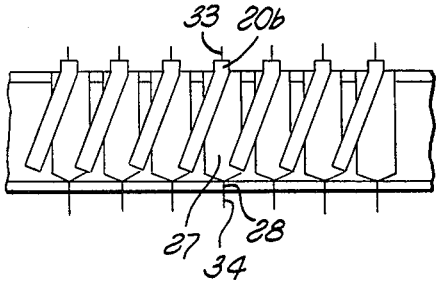
FIG. 4 is a flat development taken as in FIG. 2, but for the "canted loop" configuration according to the invention.

Referring now to FIG. 4, a second embodiment according to the invention involves canting of the rotor loop long (axial) dimensions with respect to the comparable stator loop dimensions. In this way, only a portion of each rotor loop is ever over a stator gap and the curve of magnetic coupling versus rotor assembly angle is again smoothed.

The amount of angular canting of rotor loops according to FIG. 4 is not critical as long as the angle is such that only a relatively small portion of the area of any rotor loop is over a stator gap at any rotor assembly instantaneous angle.

The first of the above-described embodiments of the invention may be referred to as the "prime related" loop configuration, while the second embodiment may be called the "canted loop" configuration.

It will be realized that both of these inventive concepts might be combined, thereby providing a rotor assembly with some loop cant angle and one (for example) rotor loop more than the number of stator loops.

Modifications and variations will suggest themselves to those of skill in this art, once the invention is understood, accordingly, it is not intended that the invention should be regarded as limited to the specific embodiment illustrated and described.

What is claimed is:

1. In a rotary loop coupler for transferring RF energy between fixed and rotating structures, said coupler having an axial central cylindrical opening adapted to fit around an elongated support member, said coupler includes first and second sets of elongated loops distributed circumferentially and about first and second circles of different radius in a plane normal to the axis of said central opening, and in which means are included for discretely energizing each loop of one set of said loops with a fraction of the total energy to be transferred between said fixed and rotating structures and for combining the energies individually magnetically coupled to the loops of the other set, the combination comprising:

first means for orienting said first set of loops such that the elongated dimensions of the loops thereof are substantially parallel to the centerline of said central cylindrical opening;

and second means comprising at least one of first and second arrangements of the loops of said second set, said first arrangement comprising a number of circumferentially uniformly spaced loops in said first set but said numbers of first and second set loops bearing a prime number relationship to each other, and said second arrangement comprising circumferentially distributed second set loops substantially uniformly canted in angle with respect to said central cylindrical opening centerline.

2. Apparatus according to claim 1 in which said first means loops are of wider dimension normal to said elongated dimensions than said loops of said second means.

3. Apparatus according to claim 1 in which said second means comprises said first loop arrangement and not said second arrangement.

4. Apparatus according to claim 1 in which said second means comprises said second loop arrangement and not said first arrangement.

5. Apparatus according to claim 1 in which said second means comprises both said first and second loop arrangements.

6. Apparatus according to claim 4 in which the numbers of loops in said first and second sets are equal.

7. Apparatus according to claim 4 in which the angle of said cant of the loops of said second set is such as to insure that no one of said second loops falls entirely over the gap between any two adjacent first loops for any circumferential relative position of said loop sets.

8. Apparatus according to claim 1 in which said first set of loops is the stator set and said second loop set is the rotor set, said second circle being of longer radius than said first circle.

9. Apparatus according to claim 2 in which said first set of loops is the stator set and said second loop set is the rotor set, said second circle being of longer radius than said first circle.

10. Apparatus according to claim 3 in which the number of said second loops is greater than the number of said first loops.

11. In a rotary loop coupler for transferring RF energy between fixed and rotating structure in which a stator set of generally axially extending elongated loops and a rotor set of generally axially extending elongated loops couple electromagnetically as said rotor set is rotated about an axis common to that of said stator set, the method of minimizing power transfer ripple, comprising at least one of two steps, said first step providing the loops of said rotor set in greater number than and in prime relationship with the number of said stator loops, and, second step angularly canting the loops of said rotor set with respect to said common axis.

12. The method according the claim 11 in which only said first step is employed.

13. The method according to claim 11 in which only said second step is employed.

14. The method according to claim 11 comprising the additional step of locating said rotor loops about a circle of greater radius than that of said stator loops.

* * * * *